US011084048B2

(12) United States Patent
Wu et al.

(10) Patent No.: US 11,084,048 B2
(45) Date of Patent: Aug. 10, 2021

(54) SHOWERS

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 69 days.

(21) Appl. No.: 16/232,939

(22) Filed: Dec. 26, 2018

(65) Prior Publication Data

US 2020/0206751 A1 Jul. 2, 2020

(51) Int. Cl.
*B05B 1/18* (2006.01)
*B05B 1/16* (2006.01)

(52) U.S. Cl.
CPC . *B05B 1/18* (2013.01); *B05B 1/16* (2013.01)

(58) Field of Classification Search
CPC ..... B05B 1/18; B05B 1/16
USPC ..... 239/397, 442, DIG. 11; 285/9.1
See application file for complete search history.

(56) References Cited

U.S. PATENT DOCUMENTS 7,251,844 B2 * 8/2007 Tai ..... A61H 7/003 239/397
2015/0115064 A1 * 4/2015 Wu ..... E03C 1/0408 239/443

* cited by examiner

*Primary Examiner* — Christopher S Kim
(74) *Attorney, Agent, or Firm* — Birch, Stewart, Kolasch & Birch, LLP

(57) ABSTRACT

A shower includes a first shower member, a second shower member and a connecting assembly. The first shower member has an inlet opening and at least one first outlet opening, wherein the inlet opening communicates with the first outlet opening. The second shower member is connected to the first shower member, and has a second outlet opening, wherein the second outlet opening communicates with the inlet opening. The connecting assembly includes a first connecting unit and a second connecting unit. The first connecting unit is positioned on one of the first shower member and the second shower member. The second connecting unit is positioned on the other one of the first shower member and the second shower member. The first connecting unit and the second connecting unit are detachably connected to each other.

18 Claims, 12 Drawing Sheets

SHOWERS

BACKGROUND OF THE INVENTION

1. Technical Field

The present disclosure relates generally to a shower, and more particularly to a shower having a connector to connect a first shower member to a second shower member.

2. Description of Related Art

A conventional shower usually includes a shower head and a spray nozzle. The shower head is usually fixed on a top of a fixed inlet member. The spray nozzle is usually connected with a hose to provide spraying water freely, wherein one end of the hose is connected to the spray nozzle, and another end of the hose is connected to the fixed inlet member.

In addition, the spray nozzle is usually temporarily fixed by a bracket while no one takes a shower, wherein the bracket is fixedly arranged beside the shower head. However, a position of the bracket is too high for a child or a person who is not tall enough to approach, so that they could not put the spray nozzle to the bracket, or could not take the spray nozzle from the bracket easily.

Accordingly, what is needed is a shower having a spray nozzle that is easy to take for users during a shower. At least for the above reasons, the conventional shower still have room for improvements.

BRIEF SUMMARY OF THE INVENTION

In view of the above, the primary objective of the present disclosure is to provide a shower, which is convenient to take a shower member for users during a shower.

The present disclosure provides a shower including a first shower member, a second shower member and a connecting assembly. The first shower member has an inlet opening and at least one first outlet opening, wherein the inlet opening communicates with the first outlet opening. The second shower member is connected to the first shower member, and has a second outlet opening, wherein the second outlet opening communicates with the inlet opening. The connecting assembly includes a first connecting unit and a second connecting unit. The first connecting unit is positioned on one of the first shower member and the second shower member. The second connecting unit is positioned on the other one of the first shower member and the second shower member. The first connecting unit and the second connecting unit are detachably connected to each other.

With the aforementioned design, the shower includes a connecting assembly to connect the first shower member and the second shower member, whereby the shower is convenient for users to take the second shower member which can provide a spray outlet function.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
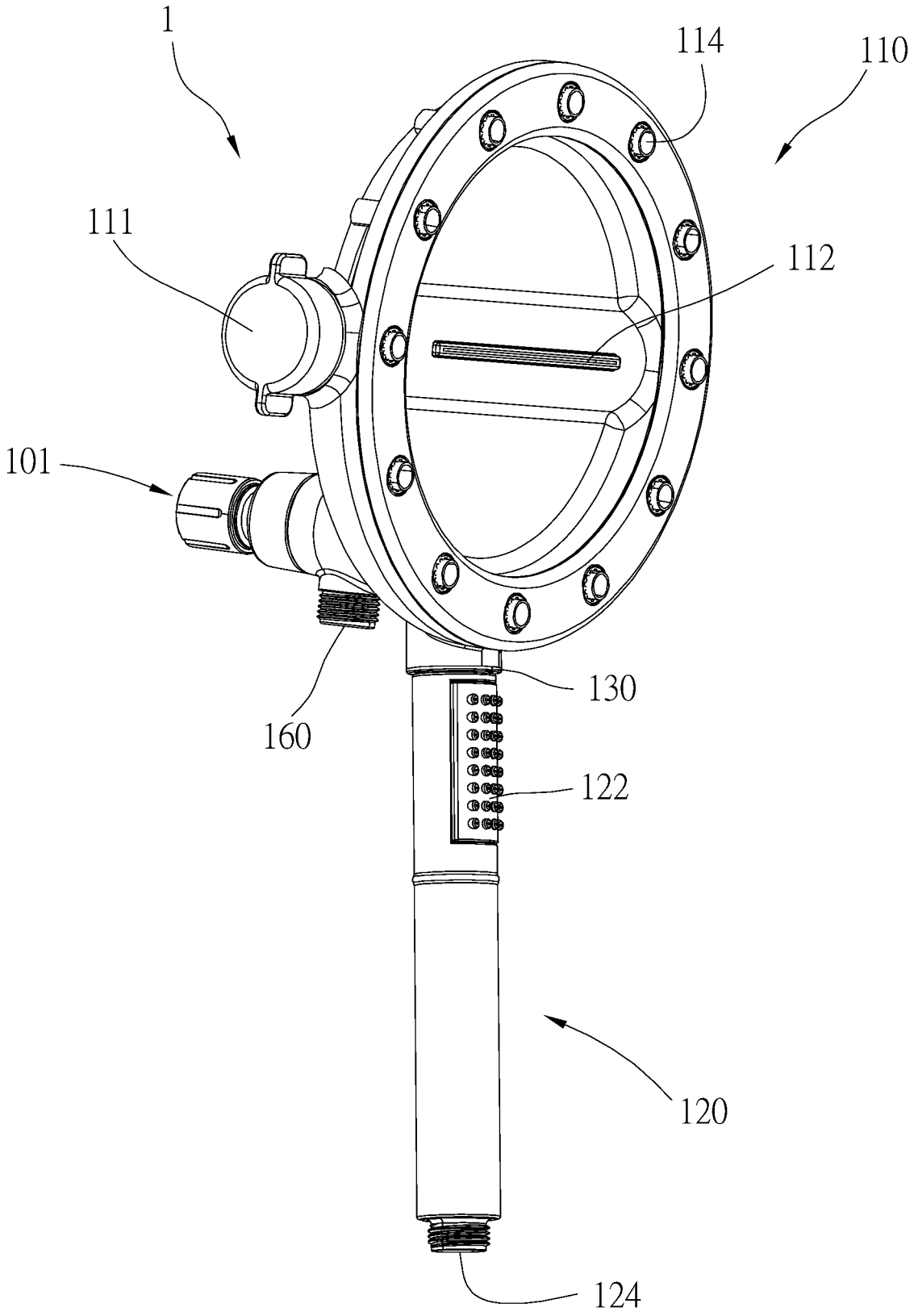
FIG. 1 is a perspective view of a shower of a first embodiment of the present disclosure.
Figure 2:
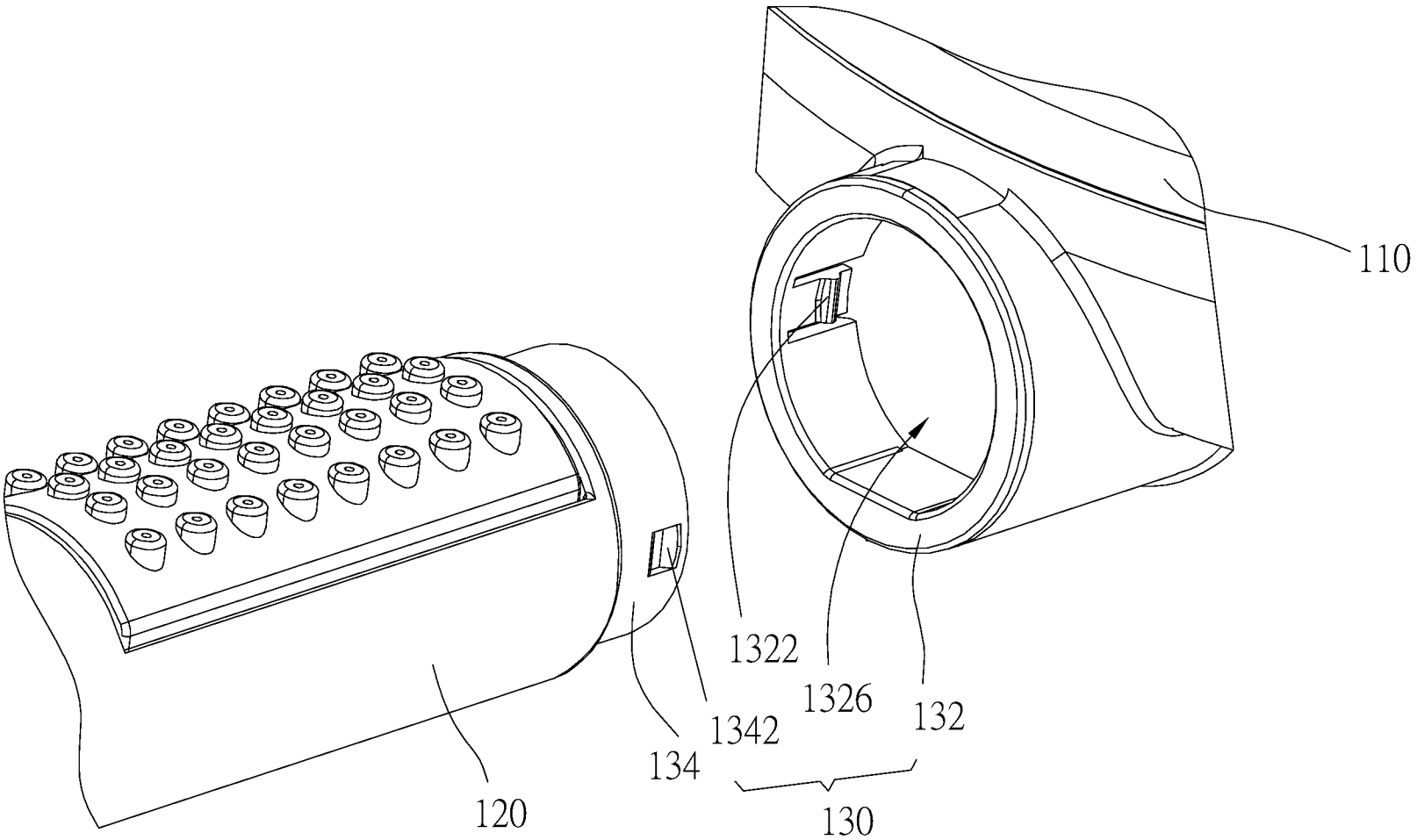
FIG. 2 is a partial exploded view of the shower of the first embodiment of the present disclosure.
Figure 3:
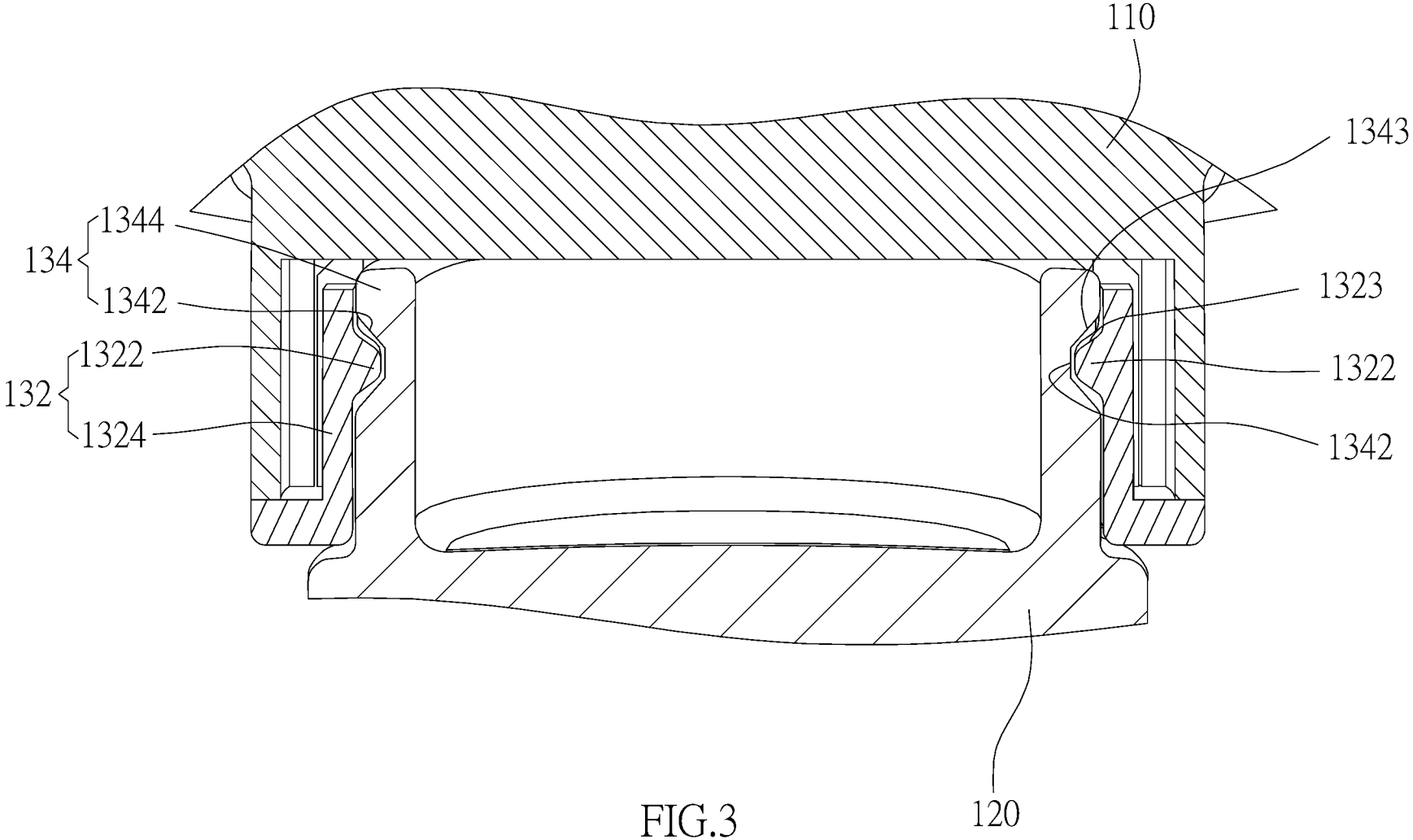
FIG. 3 is a partial cross-sectional view of the shower of the first embodiment of the present disclosure.
Figure 4:
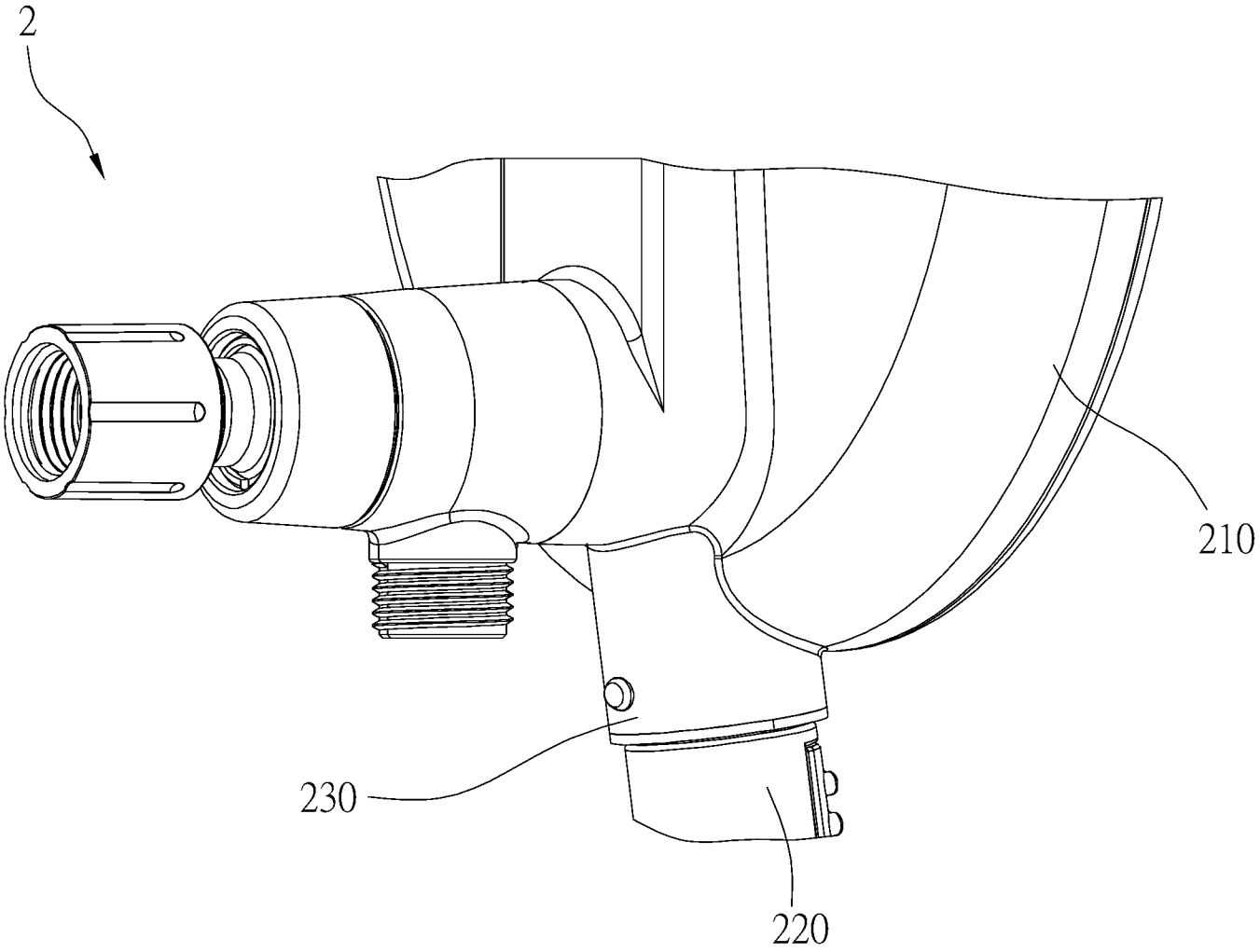
FIG. 4 is a perspective view of a shower of a second embodiment of the present disclosure.

As illustrated in FIG. 1 to FIG. 3, a shower 1 in accordance with the first embodiment of the present disclosure is provided, including a first shower member 110, a second shower member 120 and a connecting assembly 130.

The first shower member 110 has an inlet opening 101 and first outlet openings 112, 114, 160, wherein the inlet opening 101 communicates with the first outlet opening 112, 114, 1160. The second shower member 120 is connected to the first shower member 110, and has a second outlet opening 122, wherein the second outlet opening 122 communicates with the inlet opening 101. In the first embodiment of the present disclosure, the second shower member 120 has an inlet opening 124 communicating with the first outlet openings 1160 of the first shower member 110 through a hose (not shown), whereby to communicate the second outlet opening 122 with the inlet opening 101.

The connecting assembly 130 includes a first connecting unit 132 and a second connecting unit 134. The first connecting unit 132 is positioned on the first shower member 110. The second connecting unit 134 is positioned on the second shower member 120. The first connecting unit 132 and the second connecting unit 134 are detachably connected to each other. In fact, the first connecting unit 132 could be positioned on the second shower member 120, and the second connecting unit 134 could be positioned on the first shower member 110, either.

Taking the first embodiment of the present disclosure as an example, the first connecting unit 132 of the connecting assembly 130 is fixedly positioned on a bottom portion of the first shower member 110, and the second connecting unit 134 of the connecting assembly 130 is fixedly positioned on a top portion of the second shower member 120. In another embodiment of the present disclosure, the first connecting unit 132 of the connecting assembly 130 could be fixedly positioned on a top portion of the second shower member 120, and the second connecting unit 134 of the connecting assembly 130 could be fixedly positioned on a bottom portion of the first shower member 110, either.

In the first embodiment of the present disclosure, the first connecting unit 132 includes protrusions 1322, and the second connecting unit 134 includes recesses 1342, wherein the protrusions 1322 are respectively detachably positioned in the recesses 1342, as shown in FIG. 2 and FIG. 3.

The first connecting unit 132 includes an opening 1326, and the second connecting unit 134 includes an end portion 1344. The end portion 1344 is detachably positioned in the opening 1326. The protrusions 1322 are positioned in the opening 1326, and the recesses 1342 are positioned on the end portion 1344. When the end portion 1344 of the second connecting unit 134 is positioned in the opening 1326 of the first connecting unit 132, the protrusions 1322 are respectively positioned in the recesses 1342.

In addition, the first connecting unit 132 includes first elastic bodies 1324, the protrusions 1322 are respectively positioned on the first elastic bodies 1324, and the first elastic bodies 1324 are positioned in the opening 1326. Furthermore, each of the protrusions 1322 is positioned between one of the first elastic bodies 1324 and the second connecting unit 134.

According to the first embodiment of the present disclosure, when the end portion 1344 of the second connecting unit 134 goes into the opening 1326 of the first connecting unit 132, an outer surface of the end portion 1344 abuts against the protrusions 1322 and the first elastic bodies 1324. Thereby, the protrusions 1322 and a free end of the first elastic bodies 1324 are moved away from the end portion 1344. Further, when the end portion 1344 goes into the opening 1326 until each of the recesses 1342 faces the corresponding protrusion 1322, the first elastic bodies 1324 push the protrusions 1322 into the recesses 1342, and therefore the second connecting unit 134 and the first connecting unit 132 are snap-fitted with each other.

In FIG. 3, each of the protrusions 1322 of the first connecting unit 132 includes a first guiding angle 1323. When the second connecting unit 134 is detached from the first connecting unit 132 by an external force, the first guiding angle 1323 of the protrusions 1322 of the first connecting unit 132 would guild the protrusions 1322 and the free end of the first elastic body 1324 to move away from the end portion 1344. Therefore, the protrusions 1322 of the first connecting unit 132 could be detached from the recesses 1342 of the second connecting unit 134 smoothly.

In FIG. 3, each of the recesses 1342 of the second connecting unit 134 includes a second guiding angle 1343. When the second connecting unit 134 is detached from the first connecting unit 132 by an external force, the second guiding angle 1343 of the recesses 1342 of the second connecting unit 134 would guild the protrusions 1322 and the free end of the first elastic bodies 1324 of the first connecting unit 132 to move away from the end portion 1344 of the second connecting unit 134, and therefore the protrusions 1322 of the first connecting unit 132 could be detached from the recesses 1342 of the second connecting unit 134.

As illustrated in FIG. 4 to FIG. 7, a shower 2 in accordance with the second embodiment of the present disclosure is provided, including a first shower member 210, a second shower member 220 and a connecting assembly 230.

The connecting assembly 230 includes a first connecting unit 232 and a second connecting unit 234. The first connecting unit 232 is positioned on the first shower member 210. The second connecting unit 234 is positioned on the second shower member 220. The first connecting unit 232 and the second connecting unit 234 are detachably connected to each other. In fact, the first connecting unit 232 could be positioned on the second shower member 220, and the second connecting unit 234 could be positioned on the first shower member 210, either.

Figure 5:
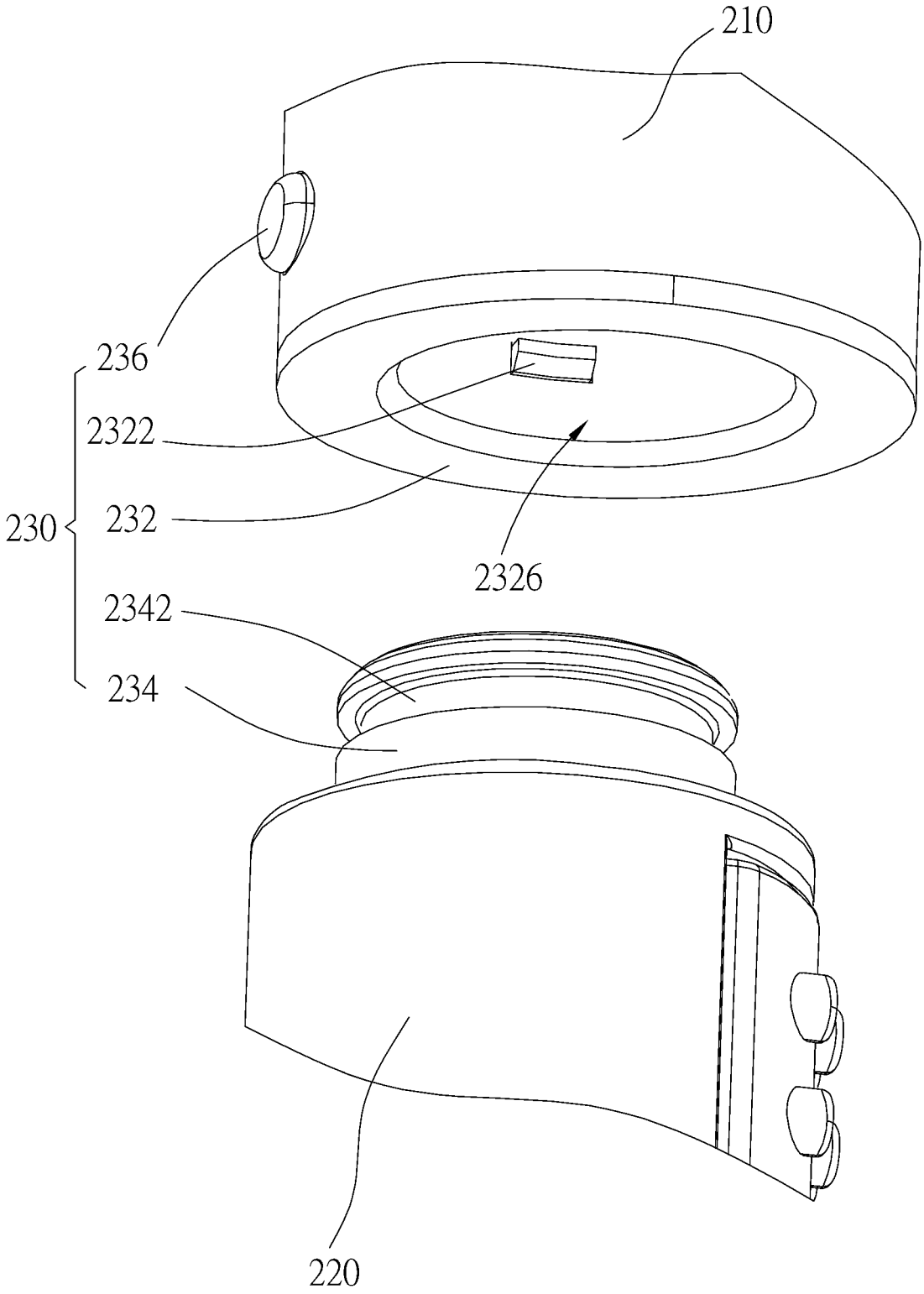
FIG. 5 is a partial exploded view of the shower of the second embodiment of the present disclosure.
Figure 6:
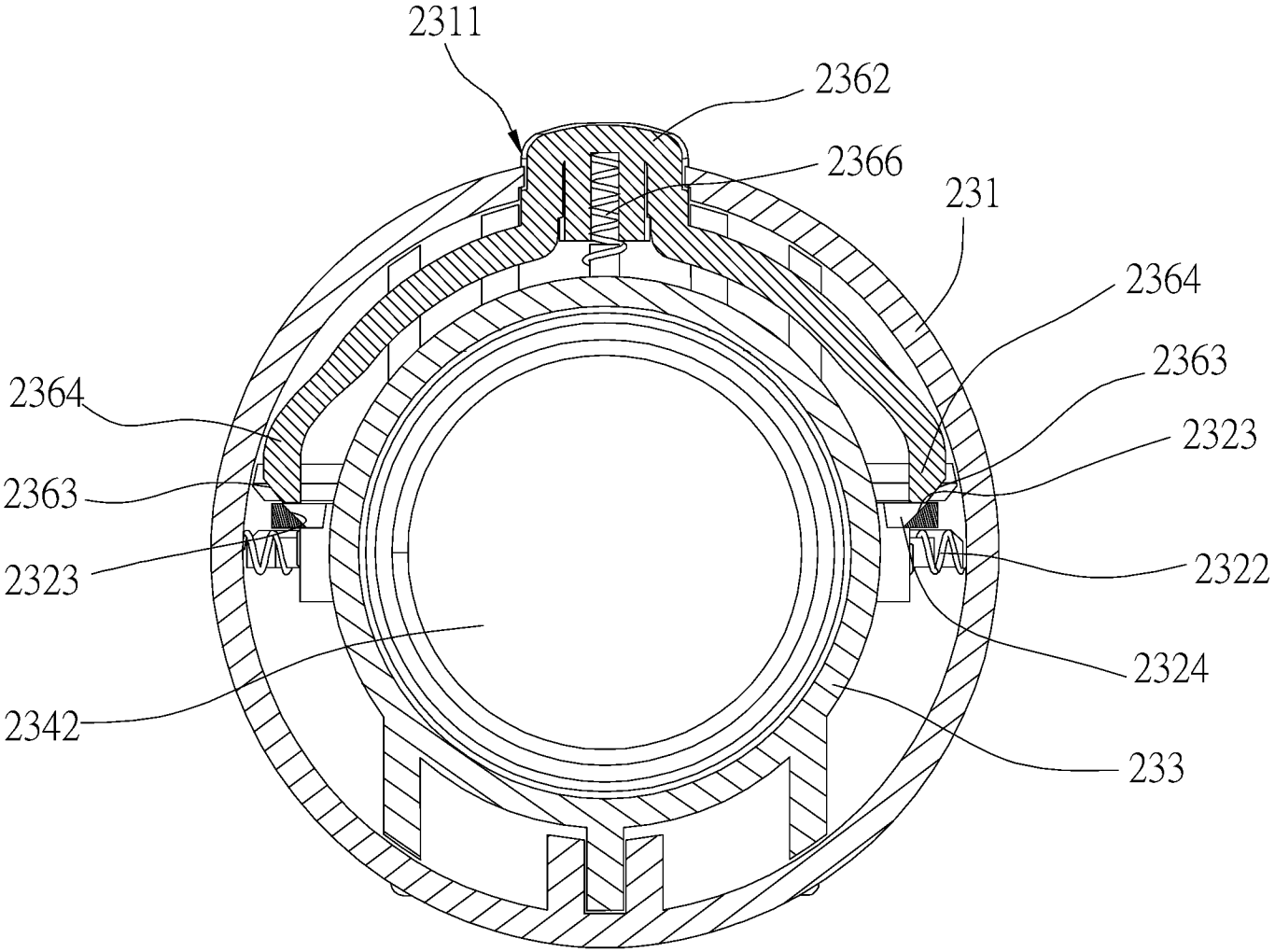
FIG. 6 is a cross-sectional view of the shower of the second embodiment of the present disclosure.
Figure 7:
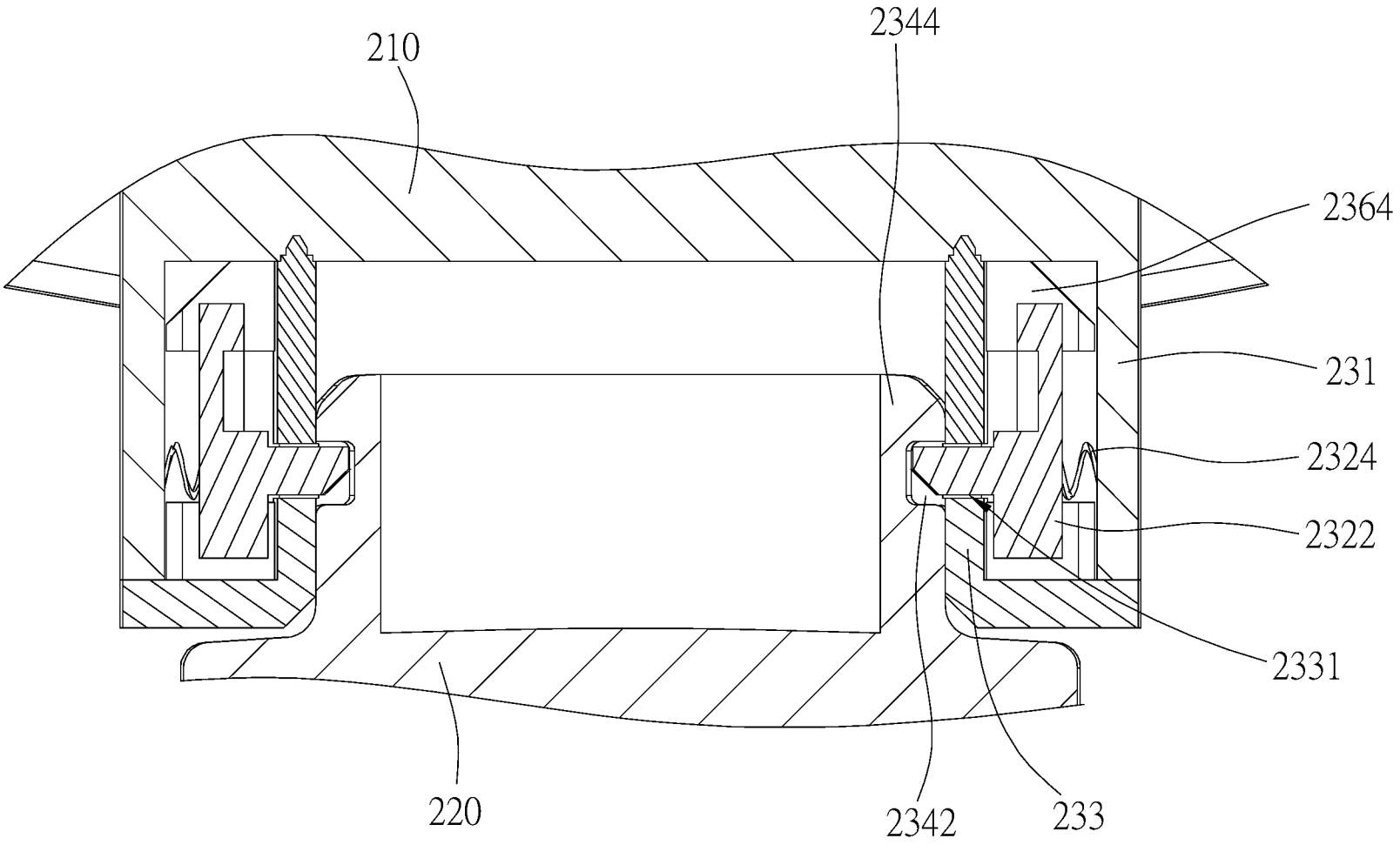
FIG. 7 is a partial cross-sectional view of the shower of the second embodiment of the present disclosure.

In the second embodiment of the present disclosure, the first connecting unit 232 includes protrusions 2322, and the second connecting unit 234 includes recesses 2342, wherein the protrusions 2322 are respectively detachably positioned in the recesses 2342, as shown in FIG. 5 and FIG. 7.

The first connecting unit 232 includes an opening 2326, and the second connecting unit 234 includes an end portion 2344. The end portion 2344 is detachably positioned in the opening 2326. The protrusions 2322 are positioned in the opening 2326, and the recesses 2342 are positioned on the end portion 2344. When the end portion 2344 of the second connecting unit 234 is positioned in the opening 2326 of the first connecting unit 232, the protrusions 2322 are respectively positioned in the recesses 2342.

Besides, the first connecting unit 232 includes a pushing member 236. The pushing member 236 passes through a hole 2311 of an outer wall 231 of the first connecting unit 232 and is movable relative to the outer wall 231. The pushing member 236 has an operating end 2362 and abutting ends 2364, wherein the operating end 2362 protrudes from the outer wall 231, and the abutting ends 2364 are positioned in the outer wall 231 and respectively abut against the protrusions 2322.

When the operating end 2362 of the pushing member 236 is moved toward the outer wall 231, the abutting ends 2364 of the pushing member 236 would push the protrusions 2322 and an end of the first elastic bodies 2324 connected to the protrusions 2322 to move away from the end portion 2344, and therefore the protrusions 2322 of the first connecting unit 232 could be detached from the recesses 2344 of the second connecting unit 234.

According to the second embodiment of the present disclosure, the first connecting unit 232 includes a second elastic body 2366. One end of the second elastic body 2366 is connected to the pushing member 236, and another end of the second elastic body 2366 is connected to an inner wall 233 of the first connecting unit 232.

When the operating end 2362 of the pushing member 236 is moved toward the inner wall 233 by an external force, the second elastic body 2366 would be compressed. Alternatively, when the external force is removed, the pushing member 236 would be pushed by the second elastic body 2366, whereby the operating end 2362 of the pushing member 236 is moved away from the inner wall 233, and therefore the pushing member 236 goes back to an original position.

Furthermore, when the pushing member 236 is pushed by the second elastic body 2366 to move the operating end 2362 of the pushing member 236 away from the inner wall 233, the abutting ends 2364 of the pushing member 236 stop abutting against the protrusions 2322, and the protrusions 2322 are respectively pushed by the first elastic bodies 2324 to move toward the end portion 2342.

According to the second embodiment of the present disclosure, each of the protrusions 2322 passes through a hole 2331 of the inner wall 233 of the first connecting unit 232. One end of each of the first elastic bodies 2324 contacts the corresponding protrusion 2322, and another end of each of the first elastic bodies 2324 contacts the outer wall 231. According to the second embodiment of the present disclosure, a movement direction of the pushing member 236 and a movement direction of the protrusions 2322 are orthogonal to each other.

According to the second embodiment of the present disclosure, each of the abutting ends 2364 of the pushing member 236 has a first inclined surface 2363, and the first inclined surface 2363 of the abutting ends 2364 of the pushing member 236 contacts the corresponding protrusion 2322. Each of the protrusions 2322 has a second inclined surface 2323, and the second inclined surface 2323 of the protrusions 2322 contacts the corresponding abutting end 2364 of the pushing member 236. According to the second embodiment of the present disclosure, the first inclined surface 2363 of the abutting ends 2364 of the pushing member 236 detachably contacts the second inclined surface 2323 of the protrusions 2322.

Figure 8:
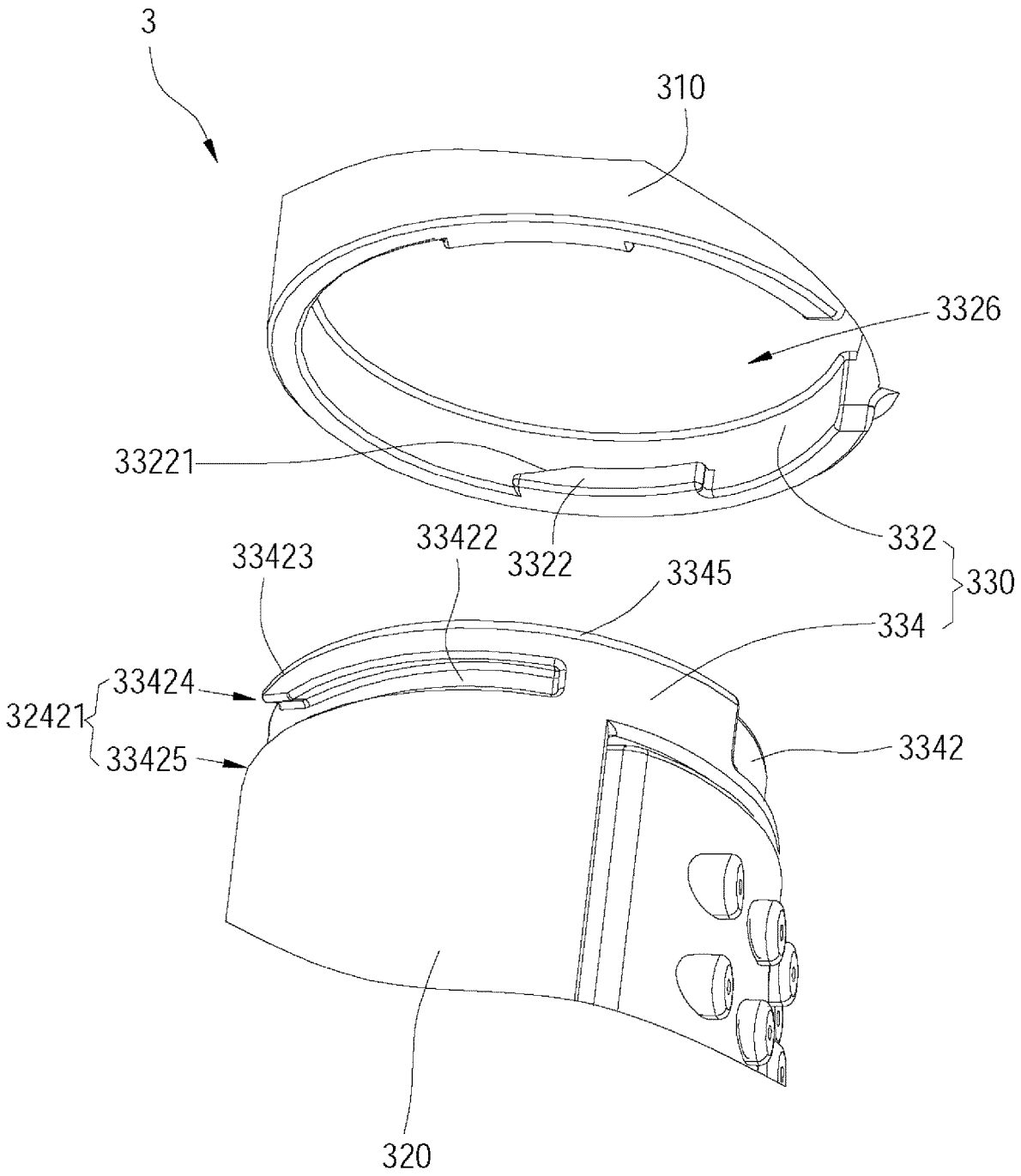
FIG. 8 is a partial exploded view of the shower of a third embodiment of the present disclosure.
Figure 9:
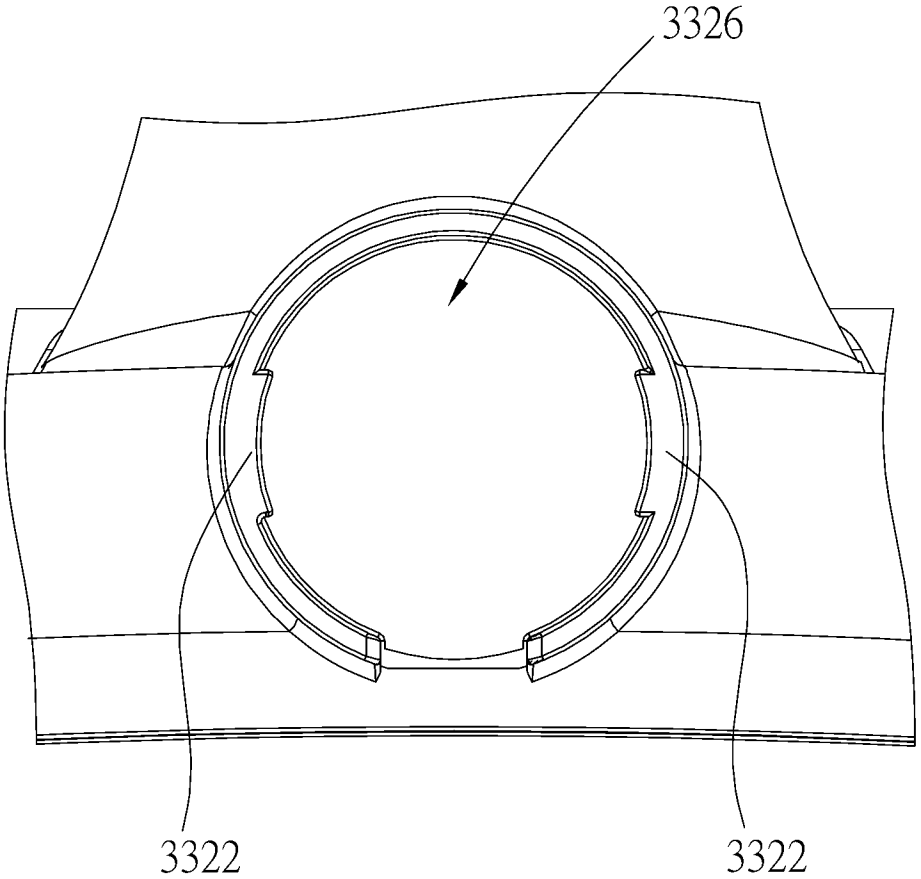
FIG. 9 is a top view of a second connecting unit of the shower and a bottom view of a first connecting unit of the third embodiment of the present disclosure.
Figure 9:
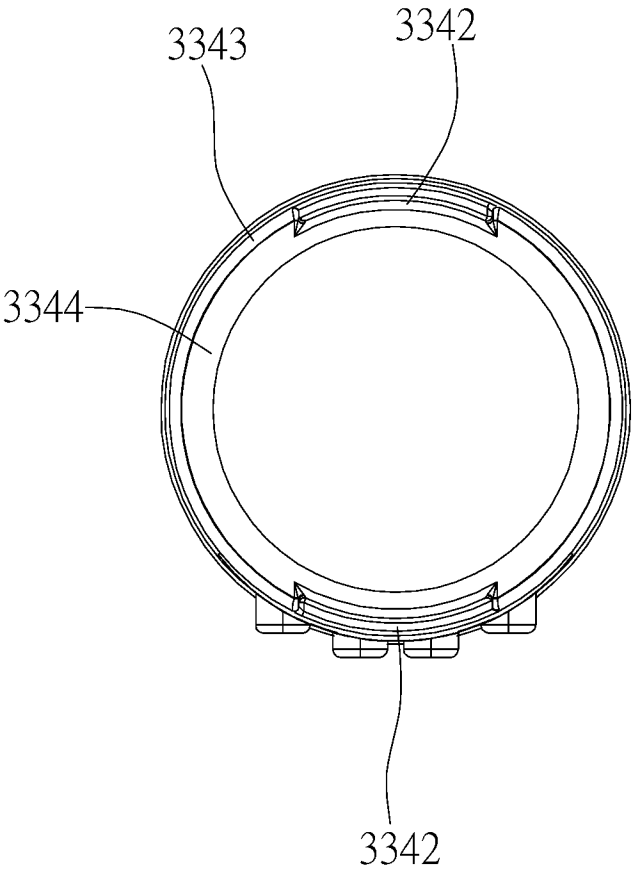

As illustrated in FIG. 8 to FIG. 9, a shower 3 in accordance with the third embodiment of the present disclosure is provided, including a first shower member 310, a second shower member 320 and a connecting assembly 330.

The connecting assembly 330 includes a first connecting unit 332 and a second connecting unit 334. The first connecting unit 332 is positioned on the first shower member 310. The second connecting unit 334 is positioned on the second shower member 320. The first connecting unit 332 and the second connecting unit 334 are detachably connected to each other. In fact, the first connecting unit 332 could be positioned on the second shower member 320, and the second connecting unit 334 could be positioned on the first shower member 310, either.

In the third embodiment of the present disclosure, the first connecting unit 332 includes protrusions 3322, and the second connecting unit 334 includes recesses 3342, wherein the protrusions 3322 are respectively detachably positioned in the recesses 3342, as shown in FIG. 8 and FIG. 9.

The first connecting unit 332 includes an opening 3326, and the second connecting unit 334 includes an end portion 3344. The end portion 3344 is detachably positioned in the opening 3326. The protrusions 3322 are positioned in the opening 3326, and the recesses 3342 are positioned on the end portion 3344. When the end portion 3344 of the second connecting unit 334 is positioned in the opening 3326 of the first connecting unit 332, the protrusions 3322 are respectively positioned in the recesses 3342.

Further, the recesses 3342 of the second connecting unit 334 includes a corresponding portion 33421 and a snap-fitting portion 33422 connected to the corresponding portion 33421. When the first connecting unit 332 and the second connecting unit 334 are connected to each other, each of the protrusions 3322 of the first connecting unit 332 is correspondingly connected to the corresponding portion 33421 of the recesses 3342, and the first connecting unit 332 and the second connecting unit 334 rotate relative to each other, and therefore each of the protrusions 3322 goes into the snap-fitting portion 33422 of the recesses 3342, so that the first connecting unit 332 and the second connecting unit 334 are snap-fit connected to each other.

According to the third embodiment of the present disclosure, the corresponding portion 33421 is recessed from a circular surface 3343 and an end surface 3345 of the end portion 334, and includes an entering end 33424 and a connecting end 33425. The snap-fitting portion 33422 is recessed from the circular surface 3343 of the end portion 334, and is extended from the connecting end 33425 in a circular direction of the end portion 334. In the third embodiment of the present disclosure, an extending range of the snap-fitting portion 33422 in the circular direction of the end portion is ⅙ to ½ of a circular length of the end portion 334.

In FIG. 8, each of the protrusions 3322 has a third inclined surface 33221, and the third inclined surface 33221 is adapted to guide the protrusions 3322 moved into the snap-fitting portion 33422 of the recesses 33421, whereby the first connecting unit 332 and the second connecting unit 334 are snap-fit connected to each other. In addition, each of the recesses 33421 has a fourth inclined surface 33423, and the fourth inclined surface 33423 is adapted to guide the protrusions 3322 moved into the snap-fitting portion 33422 of the recesses 33421, whereby the first connecting unit 332 and the second connecting unit 334 are snap-fit connected to each other.

Figure 10:
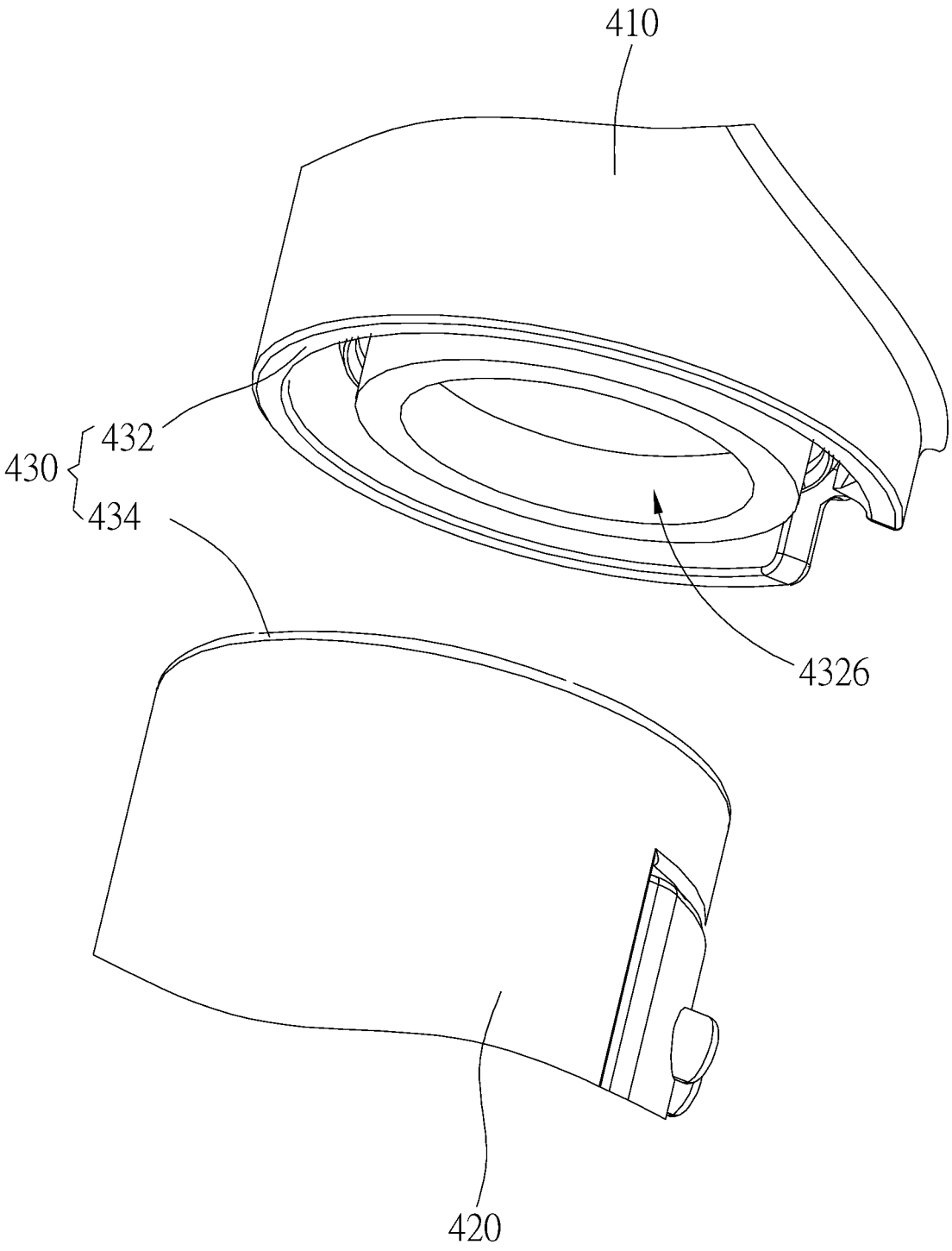
FIG. 10 is a partial exploded view of the shower of a fourth embodiment of the present disclosure.
Figure 11:
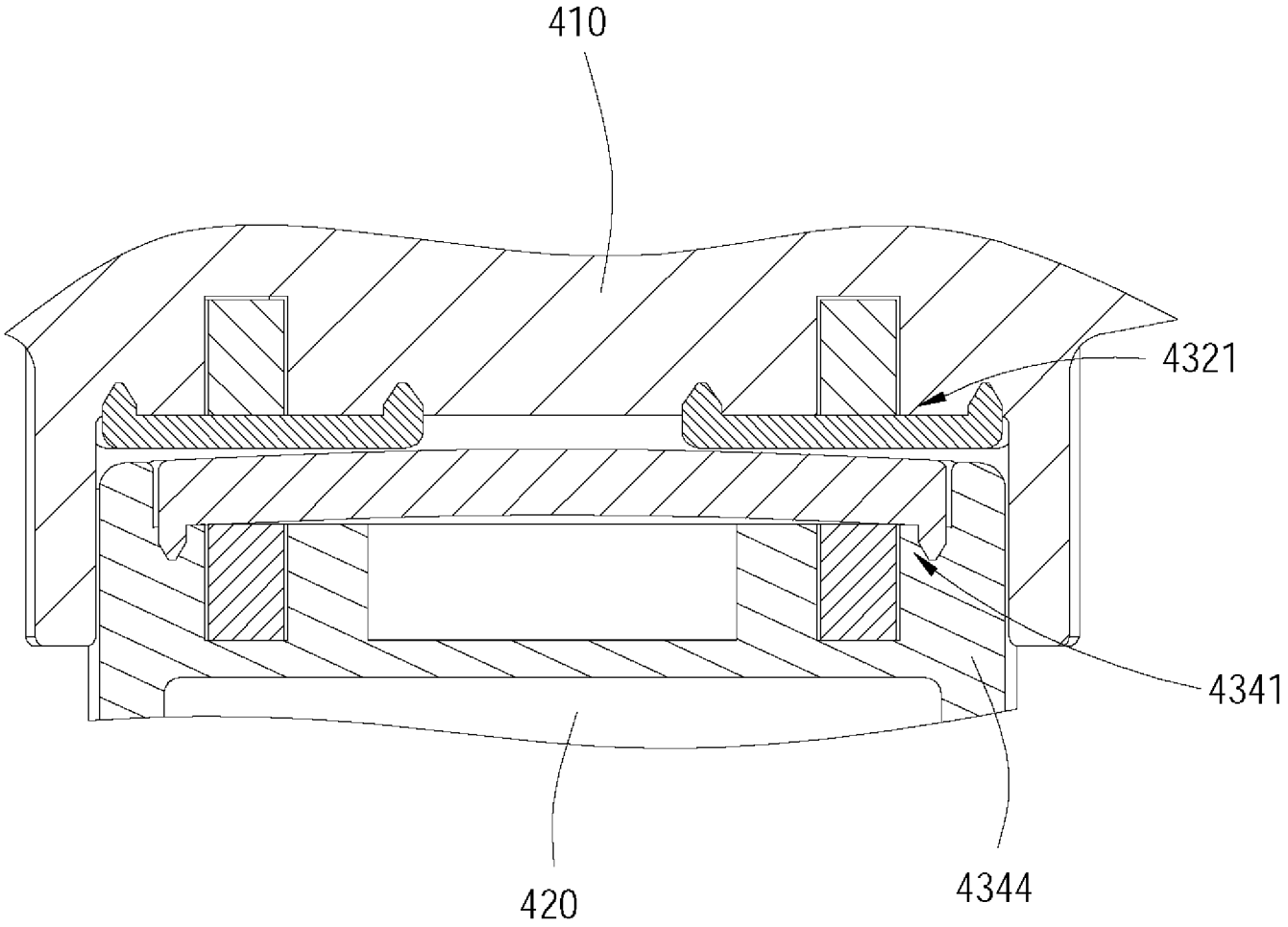
FIG. 11 is a partial cross-sectional view of the shower of the fourth embodiment of the present disclosure.
Figure 12:
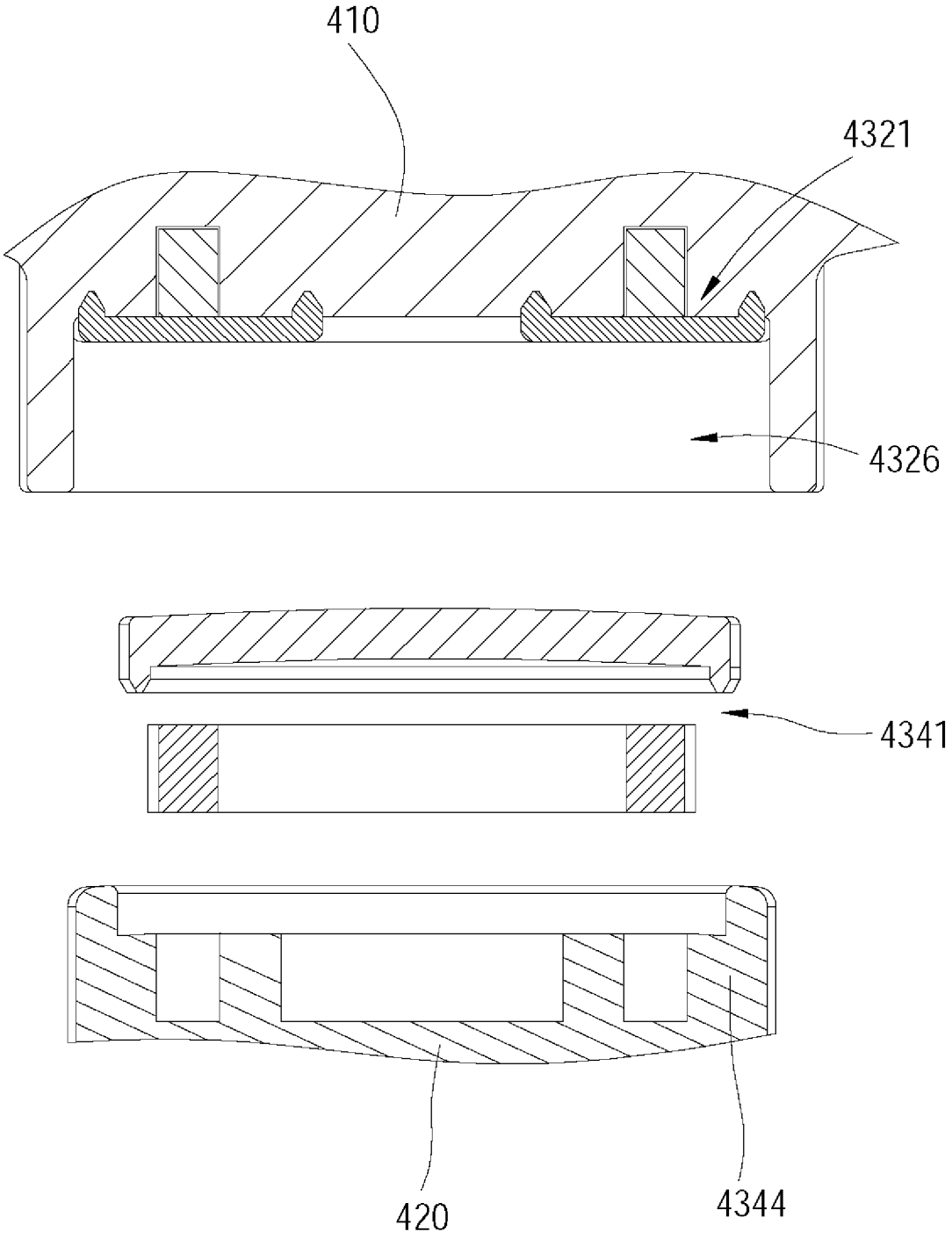
FIG. 12 is a partial exploded and cross-sectional view of the shower of the fourth embodiment of the present disclosure.

As illustrated in FIG. 10 to FIG. 12, a shower 4 in accordance with the fourth embodiment of the present disclosure is provided, including a first shower member 410, a second shower member 420 and a connecting assembly 430.

The connecting assembly 430 includes a first connecting unit 432 and a second connecting unit 434. The first connecting unit 432 is positioned on the first shower member 410. The second connecting unit 434 is positioned on the second shower member 420. The first connecting unit 432 and the second connecting unit 434 are detachably connected to each other. In fact, the first connecting unit 432 could be positioned on the second shower member 420, and the second connecting unit 434 could be positioned on the first shower member 410, either.

According to the third embodiment of the present disclosure, the first connecting unit 432 includes at least one first magnetic sticking portion 4321, and the second connecting unit 434 includes at least one second magnetic sticking portion 4341. The first magnetic sticking portion 4321 and the second magnetic sticking portion 4341 stick with each other, and thereby the first connecting unit 432 and the second connecting unit 434 are connected to each other.

According to the third embodiment of the present disclosure, the first connecting unit 432 includes an opening 4326, and the second connecting unit 434 includes an end portion 4344. The end portion 4344 is detachably positioned in the opening 4326. The first magnetic sticking portion 4321 is positioned in the opening 4326, and the second magnetic sticking portion 4341 is positioned on the end portion 4344. When the end portion 4344 of the second connecting unit 434 is positioned in the opening 4326 of the first connecting unit 432, the first magnetic sticking portion 4321 sticks with the second magnetic sticking portion 4341, and therefore the first connecting unit 432 and the second connecting unit 434 are connected to each other.

According to the third embodiment of the present disclosure, the first magnetic sticking portion 4321 has a magnet, and the second magnetic sticking portion 4341 has another magnet, wherein the magnet of the first magnetic sticking portion 4321 sticks with the magnet of the second magnetic sticking portion 4341.

According to another embodiment of the present disclosure, one of the first magnetic sticking portion 4321 and the second magnetic sticking portion 4341 has a magnetic member, and the other one of the first magnetic sticking portion 4321 and the second magnetic sticking portion 4341 has a magnetic sensitive member, wherein the magnetic sensitive member sticks with the magnetic member.

According to further another embodiment of the present disclosure, the amount of the first magnetic sticking portion 4321 is two; one of the first magnetic sticking portions 4321 has a first N-magnet, and the other one of the first magnetic sticking portions 4321 has a first S-magnet. The amount of the second magnetic sticking portion 4341 is two; one of the second magnetic sticking portions 4341 has a second N-magnet, and the other one of the second magnetic sticking portions 4341 has a second S-magnet. When the first magnetic sticking portion 4321 sticks with the second magnetic sticking portion 4341, the first S-magnet sticks with the second N-magnet, and the first N-magnet sticks with the second S-magnet.

Taking the first embodiment of the present disclosure as an example, the shower 1 includes a control member 111. The control member 111 is positioned on the first shower member 110, and could rotate relative to the first shower member 110.

In one embodiment of the present disclosure, the control member 111 includes a plurality of adjusting positions relative to the first shower member 110. When the control member 111 stays at one of the adjusting positions, one of the first outlet openings 112; 114, 160 communicates with the inlet opening 101. In other words, when the control member 111 stays at a first one of the adjusting positions, the first outlet openings 112 communicates with the inlet: opening 101; when the control member 111 stays at a second one of the adjusting positions, the first outlet openings 114 communicates with the inlet opening 101; when the control member 111 stays at a third one of the adjusting positions, the first outlet openings 160 communicates with the inlet opening 101.

In FIG. 1, the first shower assembly 110 includes a narrow longitudinal outlet unit having an outlet slot (i.e., the first outlet opening 112). The outlet slot 112 communicates with the inlet opening 101 when the outlet slot 112 stays at the first adjusting position, and thereby water could outlet from the outlet slot 112.

The first shower member 110 includes a circular outlet unit having a plurality of nozzles (i.e., the first outlet opening 114). The nozzles 114 are positioned on an outer surface of the circular outlet unit in interval, and communicate with the inlet opening 101 when the control member 111 stays at the second adjusting position, and thereby water could outlet from the nozzles 114.

The second shower member 120 has a plurality of nozzles (i.e., the second outlet opening 122) communicating with the inlet opening 124. The nozzles 122 are positioned on an outer surface of the second shower member 120, and communicate with the inlet opening 101 when the control member 111 stays at the third adjusting position, and thereby water could outlet from the nozzles 122.

According to embodiments of the present disclosure, the first connecting unit of the connecting assembly is fixedly positioned on a bottom portion of the first shower member, and the second connecting unit of the connecting assembly is fixedly positioned on a top portion of the second shower member.

With the aforementioned design, the shower includes a connecting assembly to connect the first shower member and the second shower member, whereby the shower is convenient for users to take the second shower member which can provide a spray outlet function.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A shower comprising:

a first shower member having an inlet opening and at least one first outlet opening, wherein the inlet opening communicates with the first outlet opening;

a second shower member connected to the first shower member and having a second outlet opening, wherein the second outlet opening communicates with the inlet opening; and a connecting assembly comprising a first connecting unit and a second connecting unit, wherein the first connecting unit is positioned on one of the first shower member and the second shower member; the second connecting unit is positioned on the other one of the first shower member and the second shower member; the first connecting unit and the second connecting unit are detachably connected to each other, wherein the first connecting unit comprises at least one first magnetic sticking portion, and the second connecting unit comprises at least one second magnetic sticking portion, the first magnetic sticking portion and the second magnetic sticking portion stick with each other, and thereby the first connecting unit and the second connecting unit are connected to each other, wherein the first connecting unit comprises an opening, and the second connecting unit comprises an end portion; the end portion is detachably positioned in the opening; the first magnetic sticking portion is positioned in the opening, and the second magnetic sticking portion is positioned on the end portion; when the end portion of the second connecting unit is positioned in the opening of the first connecting unit, the first magnetic sticking portion sticks with the second magnetic sticking portion, whereby the first connecting unit and the second connecting unit are connected to each other, wherein the opening of the first connecting unit is a circular opening, the end portion of the second connecting unit has a cylindrical shape and extends along a longitudinal axis of the second shower member, the second outlet opening of the second shower member is disposed on an outer peripheral surface of the second shower member and is positioned toward a lateral direction of the second shower member, and wherein an axial direction of the opening of the first connecting unit of the connecting assembly and the longitudinal axis of the second shower member are coaxial, the axial direction of the opening of the first connecting unit is perpendicular to an axial direction of the second outlet opening, the first shower member is connected to the second shower member in the longitudinal axis of the second shower member, and the axial direction of the second outlet opening is perpendicular to the longitudinal axis of the second shower member.

2. The shower of claim 1, wherein the first connecting unit comprises at least one protrusion, and the second connecting unit comprises at least one recess; the protrusion is detachably positioned in the recess.

3. The shower of claim 2, wherein the first connecting unit comprises an opening, and the second connecting unit comprises an end portion; the end portion is detachably positioned in the opening; the protrusion is positioned in the opening, and the recess is positioned on the end portion; when the end portion of the second connecting unit is positioned in the opening of the first connecting unit, the protrusion is detachably positioned in the recess.

4. The shower of claim 3, wherein the first connecting unit comprises at least one first elastic body, the protrusion is respectively positioned on the first elastic body, and the first elastic body is positioned in the opening; the protrusion is positioned between the first elastic body and the second connecting unit.

5. The shower of claim 4, wherein when the end portion of the second connecting unit goes into the opening of the first connecting unit, an outer surface of the end portion abuts against the protrusion and the first elastic body, whereby the protrusion and a free end of the first elastic body are moved away from the end portion; when the end portion goes into the opening until the recess faces the protrusion, the first elastic body pushes the protrusion into the recess, whereby the second connecting unit and the first connecting unit are snap-fitted with each other.

6. The shower of claim 5, wherein the protrusion of the first connecting unit comprises a first guiding angle; when the second connecting unit is detached from the first connecting unit by an external force, the first guiding angle of the protrusion of the first connecting unit would guild the protrusion and the free end of the first elastic body to move away from the end portion, whereby the protrusion of the first connecting unit is detached from the recess of the second connecting unit.

7. The shower of claim 5, wherein the recess of the second connecting unit comprises a second guiding angle; when the second connecting unit is detached from the first connecting unit by an external force, the second guiding angle of the recess of the second connecting unit would guild the protrusion and the free end of the first elastic body of the first connecting unit to move away from the end portion of the second connecting unit, whereby the protrusion of the first connecting unit is detached from the recess of the second connecting unit.

8. The shower of claim 4, wherein the first connecting unit comprises a pushing member; the pushing member passes through a hole of an outer wall of the first connecting unit and is movable relative to the outer wall; the pushing member has an operating end and an abutting end, the operating end protrudes from the outer wall, and the abutting end is positioned in the outer wall and abuts against the protrusion; when the operating end of the pushing member is moved toward the outer wall, the abutting end of the pushing member would push the protrusion and an end of the first elastic body connected to the protrusion to move away from the end portion, whereby the protrusion of the first connecting unit could be detached from the recess of the second connecting unit.

9. The shower of claim 8, wherein the first connecting unit comprises a second elastic body, one end of the second elastic body is connected to the pushing member, and another end of the second elastic body is connected to an inner wall of the first connecting unit; when the operating end of the pushing member is moved toward the inner wall by an external force, the second elastic body would be compressed; when the external force is removed, the pushing member would be driven by the second elastic body, whereby the operating end of the pushing member is moved away from the inner wall.

10. The shower of claim 9, wherein when the pushing member is driven by the second elastic body to move the operating end of the pushing member away from the inner wall, the abutting end of the pushing member stops abutting against the protrusion, and the protrusion is pushed by the first elastic body to move toward the end portion.

11. The shower of claim 9, wherein the protrusion passes through a hole of the inner wall of the first connecting unit; one end of the first elastic body contacts the protrusion, and another end of the first elastic body contacts the outer wall.

12. The shower of claim 8, wherein the abutting end of the pushing member has a first inclined surface, the first inclined surface of the abutting end of the pushing member contacts the protrusion.

13. The shower of claim 8, wherein the protrusion has a second inclined surface, the second inclined surface of the protrusion contacts the abutting end of the pushing member.

14. The shower of claim 3, wherein the recess of the second connecting unit comprises a corresponding portion and a snap-fitting portion connected to the corresponding portion; when the first connecting unit and the second connecting unit are connected to each other, the protrusion of the first connecting unit is correspondingly connected to the corresponding portion of the recess, and the first connecting unit and the second connecting unit rotate relative to each other, whereby the protrusion goes into the snap-fitting portion of the recess, and thereby the first connecting unit and the second connecting unit are snap-fit connected to each other.

15. The shower of claim 14, wherein the protrusion has a third inclined surface, the third inclined surface is adapted to guide the protrusion moved into the snap-fitting portion of the recess, whereby the first connecting unit and the second connecting unit are snap-fit connected to each other.

16. The shower of claim 14, wherein the recess has a fourth inclined surface, the fourth inclined surface is adapted to guide the protrusion moved into the snap-fitting portion of the recess, whereby the first connecting unit and the second connecting unit are snap-fit connected to each other.

17. The shower of claim 1, wherein the first magnetic sticking portion has a magnet, and the second magnetic sticking portion has another magnet, wherein the magnet of the first magnetic sticking portion sticks with the magnet of the second magnetic sticking portion.

18. The shower of claim 1, wherein the first connecting unit of the connecting assembly is positioned on a bottom portion of the first shower member, and the second connecting unit of the connecting assembly is positioned on a top portion of the second shower member.

* * * * *